US005451728A

United States Patent [19]

Chandler et al.

[11] Patent Number: 5,451,728

[45] Date of Patent: Sep. 19, 1995

[54] MUFFLER FOR TWO-CYCLE INTERNAL COMBUSTION ENGINE AND METHOD OF ASSEMBLY

[75] Inventors: Neal W. Chandler, Shreveport; Jeffery G. Sadler, Greenwood, both of La.

[73] Assignee: WCI Outdoor Products, Inc., Cleveland, Ohio

[21] Appl. No.: 286,261

[22] Filed: Aug. 4, 1994

Related U.S. Application Data

[63] Continuation of Ser. No. 977,682, Nov. 19, 1992, abandoned.

[51] Int. Cl.[6] ..... F01N 3/02

[52] U.S. Cl. ..... 181/230; 181/231; 181/282

[58] Field of Search ..... 181/211, 222, 230, 231, 181/232, 240, 243, 252, 255, 258, 264, 269, 272, 282

[56] References Cited

U.S. PATENT DOCUMENTS

| | | | |
|---|---|---|---|
| 3,638,756 | 2/1972 | Thiele | 181/57 |
| 3,650,354 | 3/1972 | Gordon | 181/40 |
| 4,415,059 | 11/1983 | Hayashi | 181/250 |
| 4,418,790 | 12/1983 | Agnew | 181/282 R |
| 4,759,423 | 7/1988 | Harwood et al. | 181/282 |
| 4,765,437 | 8/1988 | Harwood et al. | 181/282 |
| 4,821,840 | 4/1989 | Harwood et al. | 181/282 |
| 4,836,330 | 6/1989 | Harwood et al. | 181/282 |
| 4,894,987 | 1/1990 | Harwood et al. | 181/282 |
| 4,901,815 | 2/1990 | Harwood et al. | 181/282 |
| 4,924,968 | 5/1990 | Moring, III, et al. | 181/282 |
| 4,958,701 | 9/1990 | Moring, III, et al. | 181/282 |
| 5,004,069 | 4/1991 | Van Blaircum et al. | 181/282 |
| 5,183,977 | 2/1993 | Horitani | 181/282 R |

*Primary Examiner*—Khanh Dang

*Attorney, Agent, or Firm*—Pearne, Gordon, McCoy & Granger

[57] ABSTRACT

A muffler for a two-cycle internal combustion engine used to power lawn and garden equipment includes two mating shells and two plates, sandwiching a spark arrestor screen, are disposed between the shells to form first and second expansion chambers between each plate and the adjacent shell. The first chamber includes an opening for coupling to the exhaust port of the engine. Within one plate is stamped a first depression, a baffle within that depression, and an elongated depression separate from the first depression. In the other plate is stamped a second depression that is punched with an air passage. When mated, an attenuating tube having an entrance in the second of the two expansion chambers and an exit into the atmosphere is formed. The first and second depressions cooperate to expose a large area of the spark arrestor screen to a flow of exhaust gas from the first chamber, through the baffle and into the second chamber. The exhaust gas in the second chamber exits the muffler through the attenuating tube.

22 Claims, 1 Drawing Sheet

MUFFLER FOR TWO-CYCLE INTERNAL COMBUSTION ENGINE AND METHOD OF ASSEMBLY

This is a continuation of application Ser. No. 07/977,682, filed Nov. 19, 1992, now abandoned.

TECHNICAL FIELD

This invention relates to mufflers for internal combustion engines and pertains, more particularly, to a muffler which is well suited for installation in two-cycle engines used on garden tools such as air blowers, flexible line trimmers, chain saws and the like.

BACKGROUND OF THE INVENTION

An internal combustion engine, particularly of the two-cycle variety, is often used to power hand-held lawn and garden equipment, such as flexible line trimmers, blowers and chain saws. The noise of the internal combustion engine is not only a nuisance to the operator of the tool and to others in the vicinity, but it can also, due to the operator's very close proximity to the motor, tend to harm the operator's hearing. However, noise reduction must often be achieved at the expense of engine performance and compactness, simplicity, reliability, ease of manufacture and cost of the muffler.

Mufflers reduce the sound level of the exhaust from the engine typically by dissipating the pressure and velocity of the exhaust gas before it is released to the atmosphere. However, mufflers deleteriously affect engine performance. Dissipating pressure and velocity tends to create undesirable back pressure on the exhaust flow from the engine. Too much back pressure impedes scavenging of the engine's cylinder, reducing efficiency and power. More sophisticated and complex structures tend to be required to dissipated the noise without creating too much back pressure.

However, the same aspects that make a two-cycle engine desirable for powering handheld lawn and garden tools—compactness, simplicity, and low cost manufacture, operation and maintenance—are also desirable for a muffler. As the cost of the entire lawn and garden product is not very expensive, the muffler must be kept very inexpensive to manufacture. It also must remain compact and light-weight, as well as reliable and easily maintained. Consequently, noise reduction structures tend to be kept relatively simple, at the expense of noise reduction and engine performance.

More complex structures also present greater reliability problems. Consumers expect lawn and garden equipment to function indefinitely, without maintenance. Mufflers, mounted directly to engines for compactness, are subject to significant vibrations from operation of the engine. They are also generally subject hostile conditions of operation and storage. Mufflers for this equipment therefore face significant reliability demands. An example of this reliability problem is an attenuating tube. An attenuating tube essentially tunes the muffler and produces a flow of exhaust gas at its output at a pressure that is as close as possible to atmospheric pressure and is substantially constant. The attenuating tube is manufactured by rolling a sheet of metal into a tube, cutting the tube to the desired length, punching a hole in the exterior shell of the muffler to accommodate the tube, inserting the tube in the hole, brazing the tube in place for a good seal and then retaining the loose end of the tube by use of other components within the muffler.

Not only is it expensive to manufacture a muffler with an attenuating tube, the vibrations of the engine place the braze under great stress, and thus tend to eventually shake the tube loose.

Finally, muffler designers must also contend with the U.S. Department of Agriculture requirement that the exhaust from multi-position engines used in U.S. National Parks be vented to the atmosphere through a spark arrestor. As gas-powered lawn and garden tools, such as chain saws, are often used in U.S. National Parks, mufflers are often fitted with or are made capable of being fitted with spark arrestor. To save costs, this typically involves simply placing the spark arrestor screen between the muffler and the exhaust output port of the engine or at the output of the muffler. The positioning of the spark arrester screen becomes very important with respect to its longevity and efficiency. If the screen is placed to close to the exhaust inlet port, the screen can be degraded prematurely by the intense heat. On the other hand, if the screen is positioned too far away from the exhaust inlet port, the carbon tends to build up on the screen because the exhaust gas is too cool. The carbon build-up clogs the openings of the screen, causing an undesirable amount of back pressure that tarnishes engine performance.

U.S. Pat. Nos. 3,638,756, 4,415,059, 4,759,423, 4,765,437, 4,821,840, 4,836,330, 4,901,815, 4,924,568, 9,958,701 and 5,004,069 show various types of mufflers for large-displacement, four-cycle internal combustion engines using assembled multiple stamp-formed members that tend to simplify manufacture and assembly. However, such mufflers are unsuitable for use with two-cycle internal combustion engines used on powered lawn and garden equipment, where compactness, lightweight, simplicity, special concerns of the two-cycle engine and special requirements of the USDA are premium concerns that weigh heavily on noise reduction performance.

Prior art mufflers suitable for use with gas-powered lawn and garden tools have not offered the most desirable combination of noise reduction, engine performance, simplicity, cost and reliability. Therefore, it is one object of the invention to provide good noise reduction performance while maintaining good engine performance by using a design having reliability and low cost manufacture.

SUMMARY OF THE INVENTION

The present invention is a muffler intended primarily for use with two-cycle internal combustion engines that power lawn and garden equipment, and that has, according to various aspects of the invention, several advantages.

The muffler has improved reliability and lower cost of manufacture. The assembly is simple, as it is assembled with the fewest number of parts, and is compact and lightweight. Yet it also delivers good performance. Thus, cost of manufacturing the muffler is kept low relative to the overall cost of the engine. The assembly has several additional advantages. The assembly is strong and able to withstand vibrations associated with operation of the engine, and thus prolong its longevity. The structure of the parts of the muffler lend themselves to easy modification for adapting to different engines. Furthermore, the muffler assembly accommodates a spark arrestor in a location that improves the longevity of the flame arrestor, reduces clogging of the flame arrestor screen with carbon from the exhaust and does not significantly interfere with muffler even when the screen becomes partially clogged.

In the preferred embodiment, a muffler according to the invention is comprised of two opposing external shells that are formed by stamping a rigid material, such as sheet metal. The shells are joined in a clam-like manner with two plates extending over the openings of each of the shells to separate the interior of the two shells into two expansion chambers. One of the two plates is stamped with a depression so as to form an attenuating tube between the two plate members when the plates are mated. Each of the depressions in the two plates is punched with holes to form a baffle. A screen for serving as a spark arrestor is held in place between the two plates.

The first shell member is punched to form an opening for receiving exhaust gas from an internal combustion engine. The exhaust gas then flows through an opening in the immediately adjacent plate, past the screen arrestor, through perforations in the next plate for creating a predetermined pressure drop, and into the second expansion chamber. The exhaust gas exits the second expansion chamber through the attenuating tube that is tuned to the engine and then enters the atmosphere. The second shell member has a notch in the side for allowing the end of an attenuating tube to extend through and exit the muffler.

The spark arrestor, made from a stainless steel screen, has a perimeter that is identical in both size and shape to the plates. During assembly the screen sandwiches between the plates. Its location is optimum: it is far enough away that intense heat of the exhaust initially exiting the exhaust port on the engine does not cause it to prematurely fail, and yet close enough that deposits on the screen tend be burned off. The screen is also symmetrical, and therefore can be flipped to prolong its life. To prevent whatever material that is deposited on the screen from significantly impeding the flow of exhaust through the baffle, the area of the plates where the baffle is located are depressed slightly to increase the exposed cross-section area of the screen so that it is much larger than the cross-sectional area of the perforations forming the baffle.

The method of manufacture of the muffler also permits some modification of the muffler to accommodate different engines without retooling of the dies.

The preferred embodiment of the muffler, as well as these and other of its advantages, are illustrated in the accompanying drawings and described below.

DETAILED DESCRIPTION OF THE PREFERRED EMBODIMENT

Figure 1:
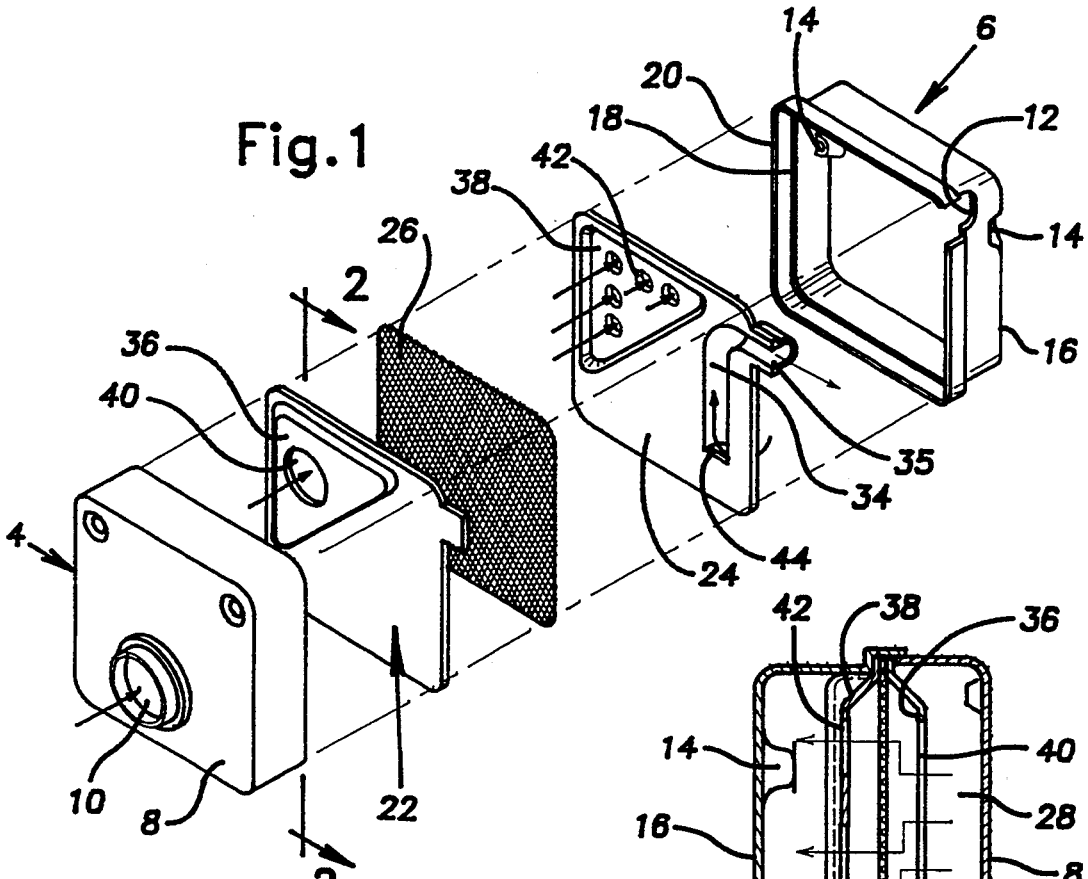
FIG. 1 is an exploded view of a preferred embodiment of a muffler.
Figure 2:
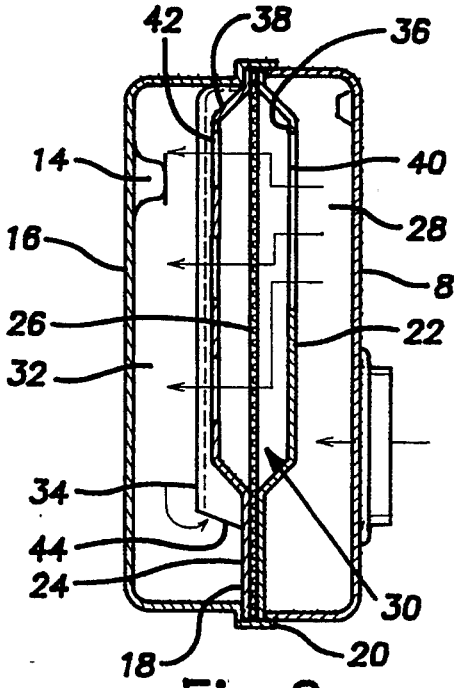
FIG. 2 is a cross sectional view of the muffler of FIG. 1.
Figure 3:
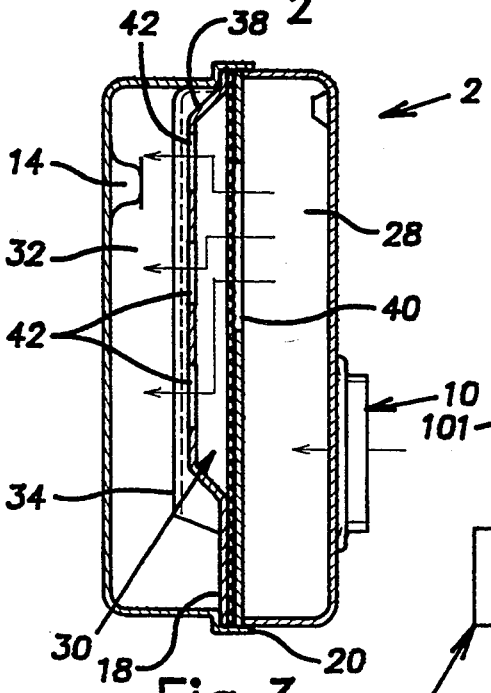
FIG. 3 is a cross sectional view of another embodiment of the muffler of FIG. 1.

Referring now to FIGS. 1–3, muffler 2 is comprised of a first and second oppositely concave complementary shell members 4 and 6, respectively. Each shell member is formed by inserting a sheet metal or other stampable material that is capable of withstanding the extreme temperatures of the exhaust gas generated by a two-cycle internal combustion engine into a press equipped with appropriately formed dies.

The first shell member 4 comprises an outer wall 8 in which an inlet port 10 is punched. Inlet port 10 is in fluid communication with an exhaust port on an internal combustion engine (not shown). The second shell member 6 has a notched outlet opening 12 in one of its side walls. Second shell member 6 also has two counter sunk holes 14 on opposite sides of its outer wall 16 for attaching springs (not shown) that secure muffler 2 to an engine.

Shell member 6 has stamped formed therein an outwardly extending ledge 18 and an outer rim 20. The ledge may be formed in either of the shell members. The ledge serves two purposes. First, the ledge serves to support first and second intermediate plates 22 and 24 and spark arrester screen 26. Second, it consists in holding the muffler assembly together for easier attachment to the engine. Usually, the shells are not joined, but are simply held together by springs used to mount the muffler to the engine so that the muffler is easily disassembled for maintenance and repair. The portion of the rim of the shell that extends slightly above the ledge may be used to seal or crimp it against the rim of the other shell to hold the muffler together and secure the plates between the two shells.

The two shell members 4 and 6 and the two plates 22 and 24 form within the muffler two expansion chambers, a baffle and an attenuating tube. Additional expansion chambers may be added if desired. A first expansion chamber 28 is formed by the first plate 22 cooperating with first shell member 4. A baffle 30 and an attenuating tube 34 are formed between first plate member 22 and a second plate member 24. A second expansion chamber 32 is formed by the second plate 24 cooperating with second shell member 6. Preferably, the velocity of the exhaust gas is slowed gradually. Therefore, the volume of the first expansion chamber 28 is preferably larger than the volume of the second expansion chamber 32.

Plates 22 and 24 are stamped out of a sheet of low carbon steel or other a rigid stampable material that is capable of withstanding the extreme temperatures of the exhaust gas generated by an internal combustion engine. The outer perimeter of each of the plates is shaped and sized to fit closely within rim 20 and to be supported by the edge of shell member 4. Each plate also includes a section that forms an outlet portion of attenuating tube 34 extending through notch 12 of shell member 6.

To form baffle 30 depressions 36 and 38 are stamped into first and second plates 22 and 24. Within depression 38 is punched an array of perforations. The baffle causes a drop in pressure of exhaust gas flowing from expansion chamber 20 to expansion chamber 32. The size, shape and placement of the perforations 42 depends on the size of the expansion chambers and the particular engine for which the muffler is designed to be used. Hole 40 is punched into depression 36 to allow flow of exhaust gas from expansion chamber 20 to baffle 42. Hole 40 has a cross-sectional area that is at least equal to, and preferably exceeds, the sum of the cross-sectional areas of the holes of baffle 42. Multiple holes may be used in place of the single hole 40. If additional losses are desired to be inserted into the flow of exhaust gas, hole 40 could be replaced with an array of perforations to form a second baffle for inserting friction losses.

Depressions 36 and 38 cooperate to expose the largest possible area of spark arrestor screen 26 to a flow of exhaust gas through baffle 42. The larger exposed area of the screen permits some accumulation of carbon and other material from the exhaust without creating additional back pressure on the flow of exhaust from the engine. As shown in FIG. 3, the intermediate chamber may be formed, if desired, with only depression 38. Plate 22 would remain flat. However, to ensure that carbon accumulation on the screen does not unduly interfere with the exhaust flow and increase back pressure, the cross-sectional area of the passage through plate 22 (hole 40) should be significantly larger than the total area of the holes of baffle 42. Varying the depth and size depression 38 during stamping of plate 24 provides adjustment of the relative volumes of expansion chambers 28 and 32 using only one part.

The spark arrestor screen 26, which is preferably made from a stainless steel mesh, has substantially the same peripheral shape and dimensions as the first and second plates 22 and 24. The spark arrestor screen must meet the Forest Service Spark Arrestor Standard set forth by the United States Department of Agriculture. This standard requires that for a gas-powered multi-position engine to be used in the U.S. forest, it must have a spark arrestor screen mesh with openings of 0.020 inches or smaller (small enough to prevent a 0.024 inch pin from fitting through). Smaller mesh openings reduce engine performance. The total area of the mesh openings exposed to the exhaust flow through the baffle is preferably 1½ times greater than the total area of the openings 42 in the second plate 24 through which the exhaust gas exits intermediate chamber 30. The screen is also symmetrical, allowing its sides to be flipped when too much material clogs the side adjacent the exhaust port of the engine.

The attenuating tube 34 is formed by stamping plate 24 with a generally half-tube-shaped depression and an opening 44 in the internal end of the tubular shaped depression. Plate 22 is not stamped with a corresponding half-tube-shaped depression, but is left flat to save cost of manufacture. If desired, plate 22 could be stamped with a corresponding half-tube-shaped depression. However, it has been found that cross-sectional shape of the attenuating robe 34 need not be perfectly circular to function. The length and cross-sectional area of the tube is chosen to create generally constant pressure at the outlet 35 of the tube at normal operating speeds of the engine to which the muffler is attached. It is possible to form the attenuating tube by locating depression 34 in plate 22 instead of plate 24. However, hole 44 would have to be punched into plate 24 to form the opening to the tube, adding additional steps to the fabrication process.

The attenuating tube 34 is shaped in an "L". This shape serves several functions. It permits the inlet 44 of the tube to be located as far away as possible from perforations 42. It also allows the necessary length of tubing to be formed on plate 24 with the depression 38 while keeping the dimensions of the muffler compact and orienting the exit 35 of tube at a fight angle to the muffler housing to further simplify manufacture. However, the tube may be any shape that is allowed by the particular design. It may be straight or bent at an obtuse angle. It may even be bent into a coil to make it more compact.

The placement of the plates and the interposed screen depends on the placement of the ledge 18. Because the shell members are stamp formed, the positioning of the ledge, and thus the position of the plates and screen can be moved. Accordingly, the position of the screen may be moved either closer to or farther away from the exhaust gas output to conform to the engine requirements. The muffler can be easily modified to accommodate different engine requirements without incurring significant retooling expenses. For example, the depth, and hence the volume, of the shells can be changed without changing the dies, thus permitting the muffler to be modified to match different engines without incurring the significant expense of retooling.

Figure 4:
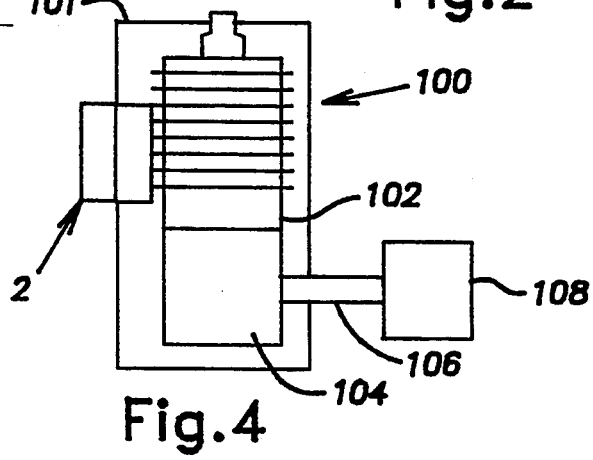
FIG. 4 is schematic representation of a lawn and garden tool powered by a two-stroke internal combustion engine.

Referring now to FIG. 4, schematically illustrated is a conventional configuration for a lawn and garden tool, such as a chain saw, flexible line trimmer or blower. As is well known in the art, such an apparatus includes a two-stroke engine 100 mounted within a housing 101. The engine includes a cylinder 102 and a crankcase 104. The engine output is delivered, through coupling 106, to work producing implement 108. Muffler 2 is coupled to an exhaust port on the cylinder so that the inlet port 10 (FIG. 1) meets with the exhaust port opening to allow fluid communication of the exhaust gases with the muffler.

Having described specific embodiments of the present invention, it is understood that various modifications thereof may be suggested to those skilled in the art, and it is intended to cover all such modifications as fall within the scope of the appended claims.

We claim:

1. A muffler for coupling to an exhaust output of a small displacement two-cycle internal combustion engine used on lawn and garden tools, the muffler comprising:

a first expansion chamber;

a second expansion chamber;

first and second abutting plates separating the first and the second expansion chambers, wherein at least one hole is formed on said first plate and at least two holes are formed on said second plate;

wherein the first and second abutting plates form an intermediate chamber to baffle a flow of exhaust gas from the first chamber to the second chamber thereby inducing a pressure drop in the flow of exhaust gas;

wherein the first and second plates further form an elongated, generally tubular-shaped sound attenuation chamber defined by spaced-apart surface portions of the first and second abutting plates, the attenuating tube having an entrance defined through one of the first and second abutting plates adjacent the second expansion chamber in the second chamber for receiving the flow of exhaust gas from the second chamber and an exit to the atmosphere for expelling the flow of exhaust gas from the muffler; and a spark arrestor screen placed and held between the first and second plates, across the flow of exhaust gas through the baffle.

2. The muffler of claim 1 wherein the intermediate chamber is formed by a depression in the first plate wherein said depression exposes the spark arrestor screen to the flow of exhaust and thereby alleviating reduced exhaust flow due to a build-up of carbon deposited on the screen by exhaust flow.

3. The muffler of claim 2 wherein the intermediate chamber is further formed by a depression in the second plate opposite the depression in the first plate.

4. The muffler of claim 1 wherein the spark arrestor screen has first and second sides and is symmetrical so that either the first or the second side may be exposed to the flow of exhaust gas; and wherein the muffler is easily disassembled to permit flipping of the spark arrestor from the first side to the second side.

5. A muffler having good performance, low cost manufacture and good reliability for use with a small displacement two-cycle internal combustion engine used on lawn and garden tools, the muffler comprising:

first and second shells joined along their edges to form an enclosure, the first shell having an opening adapted to receive from an exhaust port of an engine a flow of exhaust gas;

first and second abutting plates held between the first and second shells, the first plate and the first shell forming a first expansion chamber and the second plate and the second shell forming a second expansion chamber;

an intermediate chamber formed between the first and second plates for passing a flow of gas from the first expansion chamber to the second expansion chamber while inducing a pressure drop in the flow of gas;

an attenuating tube formed by a depression in one of the first and second plates and the other of the first and second plates, the tube having an entrance opening in the second expansion chamber, the tube extending between the edges of the first and second shells and having exit opening for expelling the flow of exhaust gas into the atmosphere at a relatively constant pressure; and a spark arrestor screen sandwiched between the first and second plates such that the flow of gas from the first expansion chamber to the second expansion chamber passes through the screen.

6. The muffler of claim 5 further comprising at least one hole formed on the first plate and at least two holes formed on said second plate, and a depression on said first plate, wherein the open area of screen exposed by said depression is greater than the area of said at least one hole on said first plate to permit some accumulation of matter on the screen without significantly impeding the flow of exhaust gas and inducing a significant pressure drop that adversely affects engine performance.

7. The muffler of claim 5 wherein the spark arrestor screen has first and second sides and is symmetrical so that either the first or the second side may be exposed to the flow of exhaust gas; and wherein the muffler is easily disassembled to permit flipping of the spark arrestor from the first side to the second side.

8. The muffler of claim 5 wherein the attenuating tube is bent to reduce the muffler's dimensions.

9. A muffler having good performance, low cost manufacture and good reliability for use with a small displacement, two-cycle internal combustion engine used on lawn and garden tools, the muffler comprising:

first and second shells joined along their edges to form an enclosure, the first shell having an opening adapted to receive from an exhaust port of an engine a flow of exhaust gas;

a first plate overlying the first shell to form a first expansion chamber, the plate having defined therein an opening for communicating a flow exhaust gas from the first expansion chamber; and a second plate adjacent the first plate and overlaying the second shell, wherein the first and second plate define an intermediate chamber for inserting friction losses in the flow of exhaust gas from the first expansion chamber, the first and second plates having perforations having a cross-sectional flow area for communicating the flow of exhaust gas to a second expansion chamber formed by the second plate overlaying the second shell and inducing a pressure drop in the flow of exhaust gas between the first and second expansion chambers; the second plate having integrally formed therein a first, elongated depression that forms a tube between the first and second plates, the tube having an entrance opening for receiving a flow of exhaust gas from the second expansion chamber and an exit opening for emitting the flow of exhaust gas to the atmosphere; the tube functioning to emit to the atmosphere the flow of exhaust gas at a relatively consistent pressure; and a spark arrestor screen placed between the first and second plates such that the flow of exhaust gas passes through the screen.

10. The muffler of claim 9 wherein the spark arrestor screen has first and second sides and is symmetrical so that either the first or the second side may be exposed to the flow of exhaust gas; and wherein the muffler is easily disassembled to permit flipping of the spark arrestor from the first side to the second side.

11. The muffler of claim 9 further including a depression in the first plate opposite a second depression in the second plate, the depression in the first plate and the second depression in the second pate exposing a cross-sectional area of the screen to the flow of exhaust gas having openings with total cross-sectional areas greater than the cross-sectional flow area through the perforations in tho first and second plates so that accumulation of matter on the screen does not substantially impede the flow of exhaust gas and create an additional pressure drop between the first and second expansion chambers that adversely affects engine performance.

12. The muffler of claim 11 wherein the second shell includes a notch along one edge for accommodating a portion of the attenuating tube having the exit opening.

13. The muffler of claim 9 wherein the entrance opening of the attenuating tube is located in the second plate as far away as possible from the perforations in the perforations of the second plate.

14. A lawn and garden tool powered by an internal combustion engine having a muffler balancing small size, good performance, low cost manufacture and good reliability comprising:

a two-cycle internal combustion engine for supplying work to a lawn and garden tool; and a muffler coupled to an exhaust port on the engine, the muffler including:

first and second shells joined along their edges to form an enclosure, the first shell having an opening adapted to receive from an exhaust port of an engine a flow of exhaust gas;

first and second abutting plates held between the first and second shells, the first plate and the first shell forming a first expansion chamber and the second plate and the second shell forming a second expansion chamber;

at least one hole formed on the first plate and at least two holes formed on said second plate for passing a flow of gas from the first expansion chamber to the second expansion chamber while inducing a pressure drop in the flow of gas; and an attenuating tube formed between the first and second plates by a depression in one of the two plates, the two plates acting as walls for the attenuating tube, the tube having an entrance opening in the second expansion chamber, the tube extending between the edges of the first and second shells and having exit opening for expelling the flow of exhaust gas into the atmosphere at a relatively constant pressure; and a spark arrestor screen sandwiched between the first and second plates such that the flow of gas from the first expansion chamber to the second expansion chamber passes through the screen.

15. The muffler of claim 14 wherein the spark arrestor screen has first and second sides and is symmetrical so that either the first or the second side may be exposed to the flow of exhaust gas; and wherein the muffler is easily disassembled to permit flipping of the spark arrestor from the first side to the second side.

16. The muffler of claim 14 wherein the first plate includes a depression for exposing more cross-sectional area of the spark arrestor to the flow of exhaust and thereby alleviating reduced exhaust flow due to a build-up of carbon deposited on the screen by exhaust flow.

17. The muffler of claim 16 wherein the second plate includes a depression opposite the depression in the first plate.

18. The tool of claim 16 further including a depression in the second plate opposite the depression in the first plate, the depression in the first plate and the the second plate exposing a cross-sectional area of the screen to the flow of exhaust gas having openings with total cross-sectional areas greater than the cross-sectional flow area of the at least one hole in the first plate so that accumulation of matter on the screen does not substantially impede the flow of exhaust gas and create an additional pressure drop between the first and second expansion chambers that adversely affects engine performance.

19. The tool of claim 14 wherein the second shell includes a notch along one edge for accommodating a portion of the attenuating tube having the exit opening.

20. The tool of claim 14 wherein the entrance opening of the attenuating tube is located in the second plate as far away as possible from the at least two holes formed on the second plate.

21. A muffler for coupling directly to an exhaust port of a small-displacement internal combustion engine powering a portable tool, the muffler comprising:

first and second shells joined along their edges to form an enclosure, the first shell having an opening adapted to receive from an exhaust port of an engine a flow of exhaust gas;

first and second abutting plates held between the first and second shells, the first plate and the first shell forming a first expansion chamber and the second plate and the second shell forming a second expansion chamber;

an intermediate expansion chamber formed between the first and second abutting plates;

at least one hole formed on the first plate and at least two holes formed on the second plate for passing a flow of gas from the first expansion chamber to the second expansion chamber while inducing a pressure drop in the flow of gas; and an attenuating tube formed between the first and second plates by a depression on one of the first and second plates and having an entrance opening in the second expansion chamber, the tube extending between the edges of the first and second shells and having exit opening for expelling the flow of exhaust gas into the atmosphere at a relatively constant pressure;

wherein exhaust gas received from the exhaust port of the engine flows sequentially to the exit opening through the first expansion chamber, the intermediate chamber, the second expansion chamber and the attenuation tube.

22. A muffler for attenuating sound of exhaust gas from a two-stroke internal combustion engine powering a portable tool, the muffler consisting of:

a first shell;

a second shell;

a first baffle plate;

a second baffle plate; and a spark arrestor screen;

wherein the first and second shells are joined along their edges to form an enclosure, the first shell having an opening adapted to receive from an exhaust port of an engine a flow of exhaust gas; first and second abutting plates held between the first and second shells, the first plate and the first shell forming a first expansion chamber and the second plate and the second shell forming a second expansion chamber;

at least one hole formed on said first baffle plate and at least two holes formed on said second baffle plate for passing a flow of gas from the first expansion chamber to the second expansion chamber while inducing a pressure drop in the flow of gas; and an attenuating tube formed between the first and second plates by a depression in one or both of the first and second plates and having an entrance opening in the second expansion chamber, the tube extending between the edges of the first and second shells and having exit opening for expelling the flow of exhaust gas into the atmosphere at a relatively constant pressure;

wherein the spark arrestor screen is held between the first and second plates such that the flow of gas from the first expansion chamber to the second expansion chamber passes through the screen; and wherein exhaust gas received from the exhaust port of the engine flows sequentially to the exit opening through the first expansion chamber, the baffle opening, the second expansion chamber and the attenuation tube.

* * * * *